US005839967A

United States Patent [19]

Moe

[11] Patent Number: 5,839,967

[45] Date of Patent: Nov. 24, 1998

[54] IMPACT BATON HAVING FREE-FLOW MATERIAL AND METHODS THEREOF

[75] Inventor: Douglas A. Moe, Appleton, Minn.

[73] Assignee: Baton Kinetics Incorporated, Appleton, Minn.

[21] Appl. No.: 808,475

[22] Filed: Mar. 3, 1997

[51] Int. Cl.[6] ..... F41B 15/02

[52] U.S. Cl. ..... 473/47.2; 473/47.6; 473/47.7

[58] Field of Search ..... 463/47.2, 47.3, 463/47.4, 47.5, 47.6, 47.7; 135/75

[56] References Cited

U.S. PATENT DOCUMENTS

| | | |
|---|---|---|
| D. 205,456 | 8/1966 | Combs . |
| 386,078 | 7/1888 | McCormick . |
| 897,201 | 8/1908 | Gannon . |
| 1,909,932 | 5/1933 | Digel . |
| 2,026,077 | 12/1935 | True . |
| 2,162,157 | 6/1939 | Clark . |
| 2,757,002 | 7/1956 | Ryden . |
| 3,371,930 | 3/1968 | Shiga . |
| 4,533,140 | 8/1985 | Champion . |
| 5,031,827 | 7/1991 | von Braunhut . |
| 5,108,097 | 4/1992 | Ashihara . |
| 5,110,375 | 5/1992 | Parsons . |
| 5,149,092 | 9/1992 | Parsons . |
| 5,161,800 | 11/1992 | Parsons et al. . |
| 5,255,575 | 10/1993 | Williams . |
| 5,348,297 | 9/1994 | Parsons . |
| 5,356,139 | 10/1994 | Parsons . |
| 5,364,097 | 11/1994 | Lyon . |
| 5,372,363 | 12/1994 | Siddle . |
| 5,407,197 | 4/1995 | Parsons . |
| 5,447,308 | 9/1995 | Girard . |
| 5,454,565 | 10/1995 | Ramirez . |

FOREIGN PATENT DOCUMENTS

| | | | |
|---|---|---|---|
| 331035 | 9/1989 | European Pat. Off. | 473/187 |
| 332894 | 9/1989 | European Pat. Off. | 473/187 |
| 402040499 | 2/1990 | Japan | 473/187 |

OTHER PUBLICATIONS

Brochure entitled "PPCT Tactical Baton", PPCT Management Systesm, Inc., published before Mar. 3, 1997.

"Defensive Tactics Student Manual" PPCT Managements Systems, Inc., copyright 1989.

"Defensive Tactics Instructor Manual", PPCT Management Systems, Inc., copyright 1989.

*Primary Examiner*—William M. Pierce

*Attorney, Agent, or Firm*—Merchant, Gould, Smith, Edell, Welter & Schmidt, P.A.

[57] ABSTRACT

An impact baton for use in law enforcement to induce an enhanced fluid shock wave includes a handle and a striking member. The striking member defines a hollow portion having a first volume defined by a cylindrical wall having an impact surface and an end surface. A quantity of dense, flowable, particulate material is within the hollow portion. The quantity only occupies a partial amount of the first volume of the hollow portion. When the baton is moved through space at a velocity, the particulate material is adjacent to the end surface and shifts to the impact surface upon impact with a target. Upon impact with a target, the shift of the particulate material prevents the baton from rebounding off of the target muscle mass, thereby helping to induce an enhanced fluid shock wave.

15 Claims, 4 Drawing Sheets

IMPACT BATON HAVING FREE-FLOW MATERIAL AND METHODS THEREOF

CROSS-REFERENCE TO RELATED APPLICATIONS

This application claims priority under 35 U.S.C. §119(e) to United States Provisional Application No. 60/032,709, filed on Dec. 13, 1996.

FIELD OF THE INVENTION

The present invention relates generally to intermediate force impact weapons. More particularly, the present invention relates to batons for use in law enforcement to induce enhanced fluid shock waves.

BACKGROUND OF THE INVENTION

Batons are often used as intermediate force impact weapons for use by law enforcement personnel. In order to gain control of a threatening or combative person, a law enforcement officer sometimes uses intermediate levels of physical force in the form of impact weapon strikes, such as batons or nightsticks. A goal of law enforcement in detaining a threatening, combative person is to gain control over him in order to, for example, arrest him and take him into custody.

One such method of effectively using impact weapons has been based upon a principle known as the "Fluid Shock Wave Principle". In general, the Fluid Shock Wave Principle uses nerve motor points as targets. The baton is struck at a large muscle mass saturated with nerve motor points, and if done correctly, the nerves become over stimulated and experience a motor dysfunction. This motor dysfunction may temporarily immobilizes and weaken the region of the muscle mass, and is sometimes compared to a massive "Charlie-horse." If a fluid shock wave is induced into the large muscle mass, the person may experience intense pain and may be temporarily immobilized in the muscle region of impact. This may give an officer sufficient time to gain control over the subject and effect an arrest without having to escalate to a higher level of force. However, the person suffers no permanent injuries or serious bodily harm.

The mechanics of inducing a fluid shock wave in a target depends upon five factors. The first factor is the velocity of the strike. This depends upon, of course, how fast the baton is swung through space by the officer. The second factor is the strength of the strike. This depends upon the strength and mass of the officer, and how much he can transfer from his own body mass and musculature through the baton to the strike. The third factor is the duration of contact between the baton and the target area. It has been reported in the literature that the length of an energy transfer must exceed approximately 3 milliseconds in order to induce a fluid shock wave and achieve a nerve motor dysfunction. The fourth factor is the target area. The target should be a large muscle mass, with plenty of nerve endings. The fifth factor is the amount of the baton tip in contact with the target. The last 3 inches of the baton are considered the "sweet spot" and is the ideal amount of contact surface of the baton used in the strike.

At times law enforcement personnel delivering an impact weapon strike may not maintain contact with the target muscle mass long enough to induce the fluid shock wave. For example, in the heat of a rapidly evolving physical confrontation wherein an impact weapon strike is delivered, after initially striking the large muscle target, an officer's instinct may be to immediately remove the baton to reposition the baton to a follow-up striking position. Therefore, the baton may not maintain the duration of contact with the muscle mass necessary to create the desired motor dysfunction. Another problem sometimes encountered is that after striking the muscle mass, the baton may bounce off and fail to produce the necessary duration of contact in order to induce the fluid shock wave.

SUMMARY OF THE INVENTION

The present invention is directed to an impact baton for use in law enforcement to induce an enhanced fluid shock wave that substantially obviates one or more of the problems due to limitations and disadvantages of the prior art.

To achieve the advantages of the invention and in accordance with the purposes of the invention, as embodied and broadly described herein, the invention comprises an impact baton for use in law enforcement to induce a fluid shock wave. The baton includes a cylindrical handle adapted to allow for gripping by a user, and an elongated, rigid striking member including first and second opposite ends. The striking member is integral with the handle adjacent to the first end, and is substantially cylindrical and defines a hollow portion adjacent to the second end. The hollow portion has a first volume defined by a cylindrical wall having an impact surface and an end surface. A quantity of dense, flowable, particulate material is positioned within the hollowed portion. The quantity only occupies a partial amount of the first volume of the hollowed portion. The quantity is sufficient such that when the baton is swung through air at a first velocity, the particulate material is adjacent to the end surface of the cylindrical wall of the hollow portion and shifts to the impact surface of the cylindrical wall of the hollow portion upon impact with a target.

Preferably, the quantity of particulate material occupies two-thirds of the first volume of the hollow portion. The quantity of particulate material may occupy in a range of from one-half to three-fourths of the first volume of the hollow portion.

One type of particulate material may include a free-flow lead having an average diameter in a range of about 0.0116–0.0232 inch.

In one embodiment, the striking member is telescoping, and is constructed and arranged to be movable between a closed position and an extended position. The striking member may include a removable tip, wherein the removable tip defines the hollow portion. The removable tip may include a housing defining the hollow portion for holding the particulate material, and a connector constructed and arranged to attach the housing to the striking member.

In other embodiments, a housing for containing the particulate material is positioned within the hollow portion of the striking member.

The handle may be positioned substantially orthogonal to the striking member. Alternatively, the handle may be axially aligned with the striking member.

In another aspect, the invention includes a tip for use with an impact baton. The tip comprises a housing having a substantially cylindrical wall and first and second opposite ends defining a cavity. The first end is closed, and the second end is selectively openable and closable. The cavity has a first volume. A connector includes a housing-engaging end and an opposite, baton-engaging end. The connector includes first attachment structure at the housing-engaging end constructed and arranged to secure the connector to the housing at the second end of the housing and close the second end. The connector also includes second attachment structure at the baton-engaging end constructed and arranged to secure the connector to an impact baton. A quantity of dense, flowable, particulate material is positioned within the cavity. The quantity only occupies a partial amount of the first volume of the cavity.

The quantity of particulate material may be no more than two-thirds of the first volume. Preferably, the quantity of particulate material is within a range of about one-half to about two-thirds of the first volume.

Preferably, the particulate material comprises free-flow lead having an average diameter in a range of about 0.0116–0.0232 inch.

In another aspect, the invention is directed to a method, for use in law enforcement, for inducing an enhanced fluid shock wave in a target muscle mass of a human subject. The method includes steps of first, providing a baton including a handle and a striking member integral therewith. The striking member includes a cylindrical wall defining a hollow portion. The cylindrical wall includes an impact portion and an end portion, where the impact portion is located closer to the target muscle area of a human subject than the end portion. The hollow portion has a first volume. The baton also includes a quantity of dense, flowable, particulate material within the hollow portion. The quantity only occupies a partial amount of the first volume of the hollow portion. Next, the method includes grasping the handle and moving the striking member through a space at a velocity sufficient to cause the particulate material to be located adjacent to the end portion. The target muscle mass of the human subject is struck with the striking member and the impact causes the particulate material to shift to the impact portion. Finally, contact is maintained between the striking member and the target muscle mass of the human subject for a period of time, wherein the shift of the particulate material prevents the striking member from rebounding off of the muscle mass.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention. In the drawings:

DETAILED DESCRIPTION OF THE PREFERRED EMBODIMENTS

The invention is directed to a baton for use in law enforcement to induce an enhanced fluid shock wave. The baton includes a hollow portion, or a cavity, within the striking member of the baton. A dense, free-flow, particulate material is positioned within the hollowed portion so that upon impact, the particulate material shifts from the interior wall of the top end of the hollow portion to the impact side and prevents the baton from rebounding off from the target muscle mass. This allows the baton to maintain contact with the target muscle mass for the appropriate duration in order to induce an enhanced fluid shock wave and cause immobilization of the target region.

Figure 1:
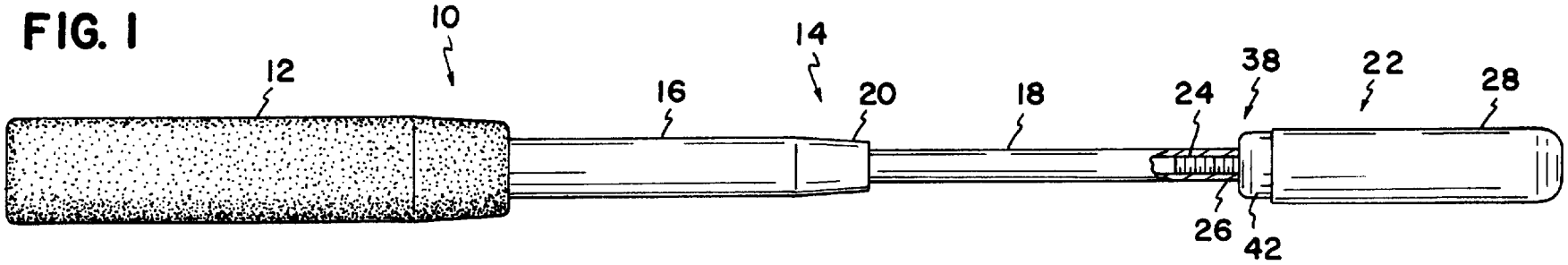
FIG. 1 is a top plan view of a first embodiment of a baton, embodying principles of the present invention.
Figure 2:
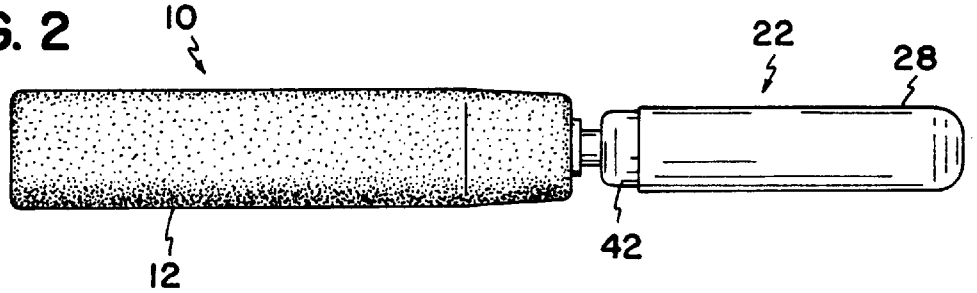
FIG. 2 is a top plan view of the FIG. 1 embodiment of a baton in a storage position, embodying principles of the present invention.
Figure 3:
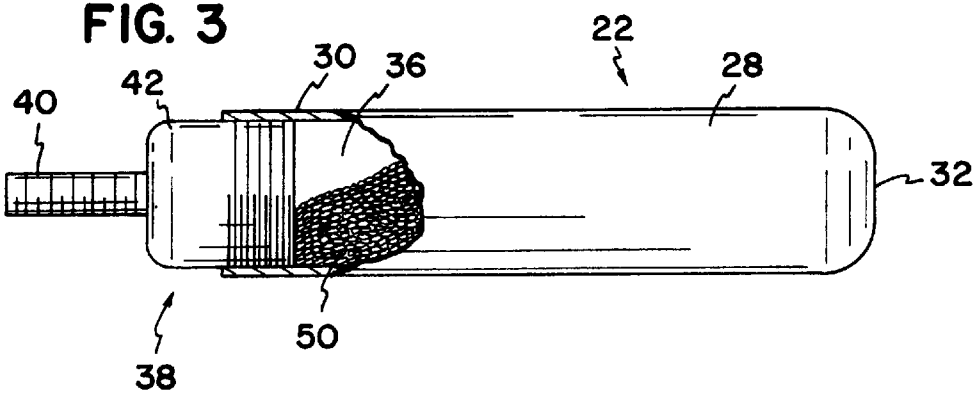
FIG. 3 is top plan view, partially broken away, of a baton tip of the FIG. 1 embodiment, embodying principles of the present invention.

A first embodiment of an impact baton is illustrated in FIGS. 1 and 2, generally at 10. Baton 10 includes a cylindrical handle 12 adapted to allow for gripping by a user. In preferred embodiments, the handle 12 is constructed from a hard, rigid, material, such as steel, and is covered by a padding material for secure, non-slip gripping. Baton 10 includes an elongated, rigid striking member for delivering impact to a target area. In the embodiment illustrated in FIG. 1, one example of a striking member is shown at 14 and includes a pair of telescoping sections. A first telescoping member 16 is integrally connected to handle 12. First telescoping member is generally cylindrical in shape, and slides within handle 12 in its storage position (FIG. 2). Second telescoping member 18 extends between an end 20 of first telescoping member 16 and a removable tip 22. Second telescoping member is generally cylindrical in shape and slides within the interior of first telescoping member 16 in its storage position (FIG. 2). Second telescoping member includes an internal threaded region 24 at an end 26. First and second telescoping members 16, 18 are preferably constructed from a rigid, dense material, such as steel. The telescoping nature of baton 10 is known in the art, such as that described in U.S. Pat. No. 5,348,297 to Parsons, hereby incorporated by reference.

FIG. 1 illustrates baton 10 in its extended position. The extended position is the position which baton will be in when an officer is using baton 10 to deliver an impact blow to a target area. FIG. 2 illustrate baton 10 in a closed position. The FIG. 2 position is the position which the baton is usually carried in by the police officer when the baton is not in use.

Figure 4:
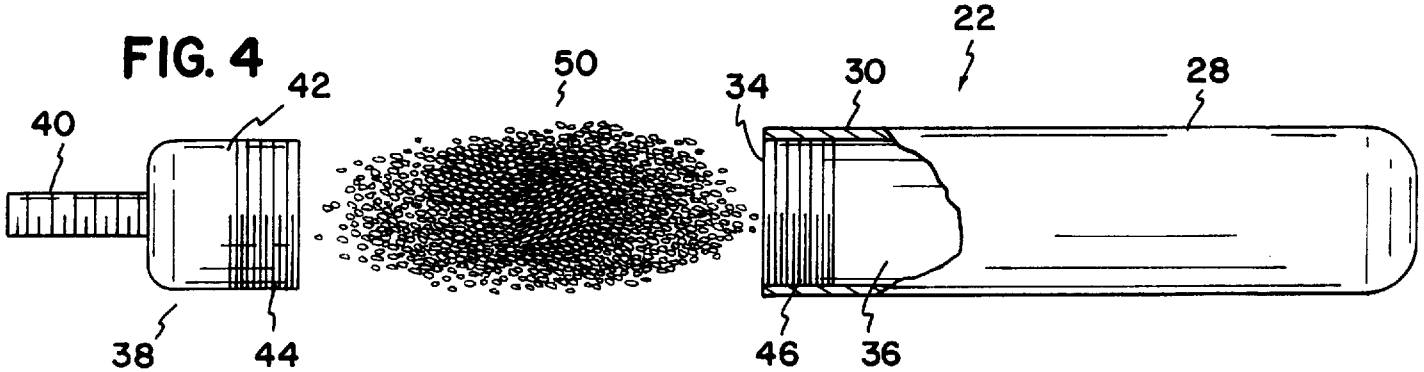
FIG. 4 is an exploded top plan view of the baton tip of FIG. 3, embodying principles of the present invention.

Tip 22 defines one end of striking member 14. In the illustrated embodiment, tip 22 does not retract within handle 12 when baton 10 is in its storage position, but can retract within the handle in other contemplated embodiments. Tip 22 includes a housing 28 including a substantially cylindrical wall 30. Housing 28 is closed at one end 32 and is selectively openable and closable at an opposite end 34 (FIG. 4). Together, cylindrical wall 30, end 32, and end 34 define a cavity, or hollow portion 36. One preferred usage for hollow portion 36 is to hold particulate material, to be described in more detail below.

Tip 22 also includes a connector 38 for securing housing 28 to the rest of baton 10. Connector 38 includes a threaded stem 40 and a cylindrical cup 42. Cylindrical cup 42 includes a threaded portion 44 on an outside surface thereof, for threadably engaging with a mating threaded portion 46 on an interior surface of wall 30 of housing 28.

In accordance with the invention, the baton includes a quantity of dense, flowable, particulate material within the hollow portion of the striking member. As embodied herein, a dense, flowable, particulate material is illustrated in FIGS.

3 and 4 at 50. Particulate material 50 is in a sufficient quantity to occupy only a partial amount of the volume of hollow portion 36. This is to permit particulate material to shift within housing 28 upon impact with a target. When baton 10 is swung through space toward its target, particulate material 50 will be located adjacent to the end 32 of tip 22, due to centrifugal force. Upon impact with the target, particulate material 50 will shift within housing 28 toward a portion of wall 30 which is adjacent to, or in contact with the target. The shift of particulate material 50 within tip 22 occurs within a short time after the initial strike. The shift of particulate material 50 from the end 32 (the portion at the very tip), to the portion adjacent to or in contact with the target area affects a secondary transfer of forward momentum to tip 22. This is advantageous to an officer trying to induce a fluid shock wave into a subject. The secondary transfer of momentum by the shifting of particulate material 50 creates a force in the direction of the strike toward the target area and helps the officer maintain contact between the striking member 14 and the target area. Maintaining contact for a duration of at least 3 milliseconds is one of the factors necessary for inducing a fluid shock wave into a muscle mass. The transfer of secondary momentum caused by the shift of particulate material 50 also helps baton 10 to resist rebounding off of the target area after impact.

Particulate material 50 should occupy enough of the volume of hollow portion 36 such that when it shifts after impact, there is sufficient secondary forward momentum to transfer a force that helps maintain intimate contact between striking member 14 and the target area. However, there should not be so much particulate material 50 within hollow portion 36 that a shift of particulate material does not occur. It has been discovered by the inventor that, preferably, a range of approximately one-half to about three-fourths of the volume of hollow portion 36 should be occupied by particulate material 50. Under one-half, and there is not sufficient secondary momentum produced to enhance duration of contact. More than three-fourths, and the particulate material does not shift sufficiently to create the enhanced amount of forward momentum. Most preferably, the inventor has discovered that a quantity of particulate material 50 which occupies approximately two-thirds of the volume of hollow portion 36 achieves the best results.

Preferably, in certain preferred arrangements, particulate material 50 is a free-flow lead having an average diameter of about 0.0116–0.0232 inch. This type of material is commercially available. In other embodiments, other types of materials are used for particulate material 50. For example, particulate material 50 could be any dense mass metal or substance with the mass equivalent to or greater than free flow lead, such as mercury, or other types of shot. The inventor has found that dense, small material (i.e., under a size of 0.050 inch) leads to advantages.

One example of one particular tip 22 constructed according to the present invention has the following dimensions: threaded stem 40 has a length of 0.5 inch; cylindrical cup 42 includes a outside diameter of 0.645 inch; housing 28 has an outer diameter of 0.75 inch, and an inner diameter of 0.625 inch; housing 28 has an overall length of 3 inches, and an inner length between open end 34 and an innermost tip of the inside wall 30 of 2.5 inches. The tip is hardened to about 55–60, as measured by a Rockwell hardness test. With these dimensions, the inventor has discovered that using about 2.1 ounces of free flow lead having an average diameter of about 0.0116–0.0232 inch is advantageous.

It is contemplated that the FIG. 1 embodiment may be modified by putting the particulate material into a hollow section in a tip which is integral with the baton.

The principles described with respect to the FIGS. 1–4 embodiment apply to the remaining embodiments described herein.

Figure 5:
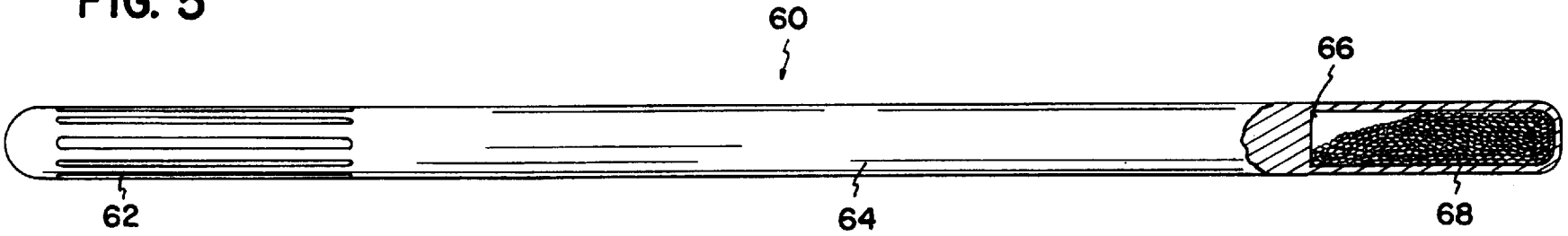
FIG. 5 is a top plan view of a second embodiment of a baton, embodying principles of the present invention.
Figure 6:
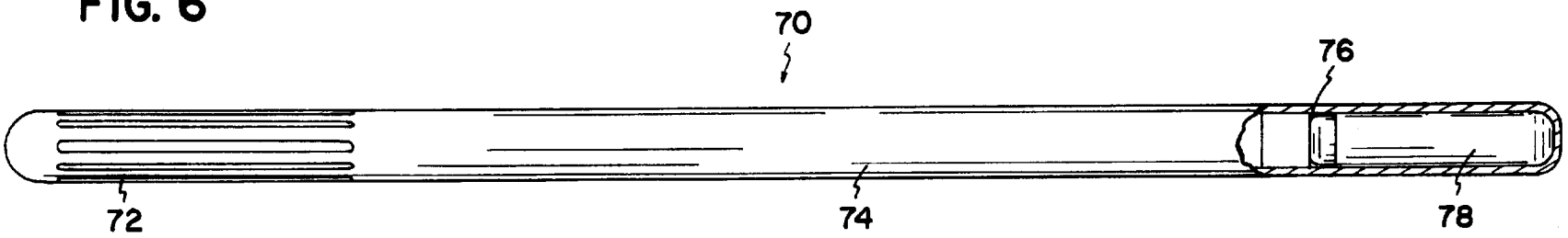
FIG. 6 is a top plan view of a modification of the second embodiment of the baton of FIG. 5, embodying principles of the present invention.

A second embodiment is illustrated in FIGS. 5 and 6. FIG. 5 shows a straight, or riot, baton 60. It includes a handle portion 62 with grooves to enhance gripping and a striking member 64. Striking member 64 is integral with, and in this particular illustrated embodiment, is a continuous part of handle portion 62. In this embodiment, striking member 64 defines a hollow portion 66 within an end region of striking member 64. Unlike the FIG. 1 embodiment, hollow portion 66 is not contained in a removable tip, but is within the tip which is integral with the baton itself. Particulate material 68 occupies a volume of hollow portion 66.

FIG. 6 is a modification of the FIG. 5 embodiment. FIG. 6 shows a straight baton 70 including a handle portion 72 and a striking member 74 integral and a continuous part of handle 72. A hollow portion 76 is defined within an end of baton 70. A housing 78 occupies hollow portion 76. Housing 78 is analogous to housing 28 and cylindrical cup 42, as described in the FIGS. 3 and 4 embodiment. Housing 78 is for holding a particulate material, as described above.

Figure 7:
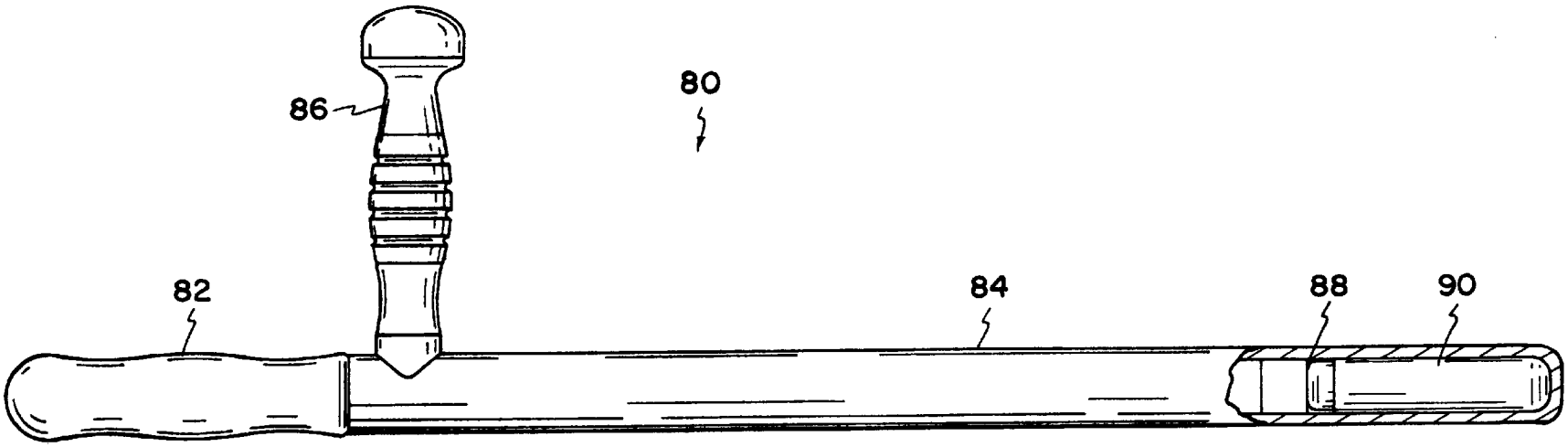
FIG. 7 is a top plan view of a third embodiment of a baton, embodying principles of the present invention.
Figure 8:
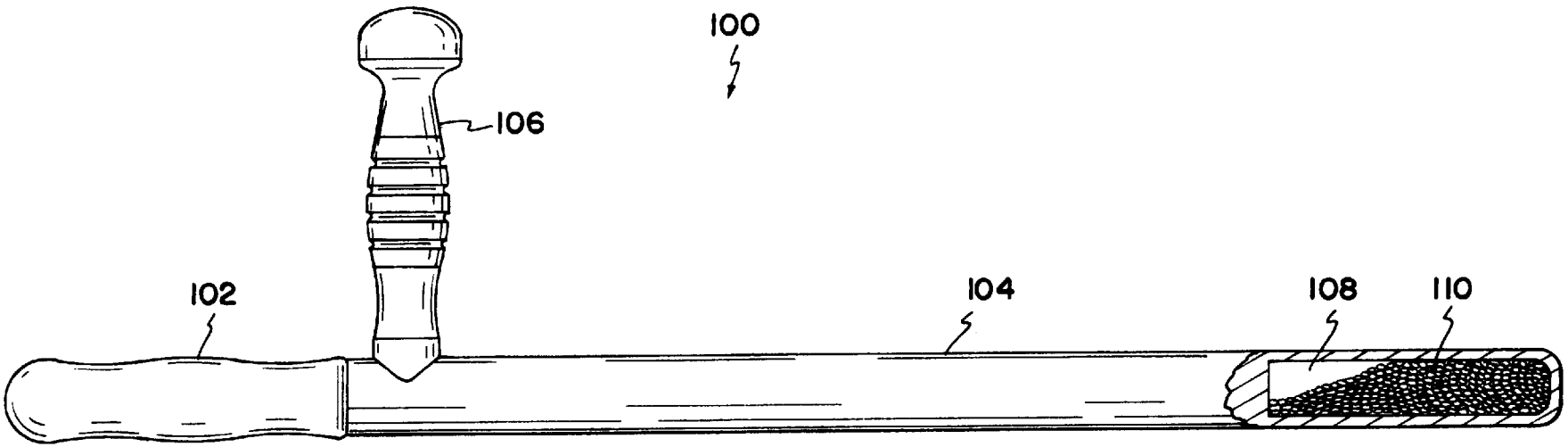
FIG. 8 is a top plan view of a modification of the third embodiment of the baton of FIG. 7, embodying principles of the present invention.

FIGS. 7 and 8 illustrate another embodiment of the present invention. FIG. 7 illustrates a side-handled baton 80. Side-handled baton 80 includes a grip 82 axially aligned with a striking member 84. A cross handle 86 is secured generally orthogonal, or perpendicular, to striking member 84 and grip 82. Striking member 84 defines a hollow portion 88 within its cylindrical walls. A housing 90 occupies hollow portion 88. Housing 90 is analogous to housing 78 in FIG. 6 and housing 28 in FIG. 4. Housing 90 holds particulate material, as described above.

FIG. 8 is an alternative arrangement of the FIG. 7 embodiment. FIG. 8 shows a side-handled baton at 100. A grip 102 is in axial alignment with striking member 104, and a cross handle 106 is secured generally orthogonal to striking member 104 and grip 102. A hollow portion 108 is defined by cylindrical walls of striking member 104. Hollow portion 108 holds particulate material 110, for shifting after impact with a target, consistent with that described above.

In accordance with the invention, the invention includes a method for inducing an enhanced fluid shock wave in a target muscle mass of a human, for use in law enforcement. The method includes steps of, first, providing a baton including a handle and a striking member integral therewith. One suitable baton includes, for example, the batons illustrated in FIGS. 1–8.

Next, the handle of the baton is grasped one-handed by the law enforcement officer, and the striking member is moved through space at a velocity sufficient to cause particulate material within the hollow portion of the baton to be located adjacent to the end portion of the cylindrical wall defining the hollow portion of the baton. In this case, the end portion of the cylindrical wall refers to the portion of the wall which is at the very tip, such as at 32 in FIG. 3. As the baton is swung through space at a certain velocity, the particulate material is caused to shift and cling toward this end of the cylindrical wall.

Next, the target is struck with the striking member. For example, when attempting to induce a fluid shock wave, the law enforcement officer aims for a large muscle mass with a large number of motor nerve endings. Examples of such areas include: the radial nerve motor point; the median nerve motor point; the common peroneal nerve motor point; the femoral nerve motor point; and the tibial nerve motor point.

After impact between the striking member and the target, the particulate material within the hollow portion shifts to the impact portion of the cylindrical wall. As used herein, the "impact portion" of the cylindrical wall refers to the portion of housing wall 30 which is either in contact with the target surface, or is adjacent to the target surface. Next, contact is maintained between the striking member and the target for a period of time sufficient to induce a fluid shock wave. For example, it has been found that a period of at least 3 milliseconds is sufficient. The shift of the particulate material prevents the striking member from rebounding off of the target surface. That is, forward momentum is transferred from the end region of the housing to the impact portion of the housing, which transfers additional energy into the target area. This additional energy helps the law enforcement officer to maintain contact between the striking member and the target area in order to induce an enhanced fluid shock wave and immobilize the target muscle area. Further, it prevents the striking member from rebounding off of the target muscle area.

Other advantages over prior art batons include its effect on persons with either thick outer clothing, or a thick layer of fat. The primary impact of the baton compresses clothing and targets the large muscle mass. The secondary impact, due to the shift of the free flow lead, directs additional energy into the muscle mass.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A tip for use with an impact baton, the tip comprising:

(a) a housing having a substantially cylindrical wall and first and second opposite ends defining a cavity; said first end being closed, and said second end being selectively openable and closable; said cavity having a first volume;

(b) a connector including a housing-engaging end and an opposite, baton-engaging end; said connector including:

(i) first attachment structure at said housing-engaging end constructed and arranged to secure said connector to said housing at said second end of said housing and close said second end; said first attachment structure including threads; and (ii) second attachment structure at said baton-engaging end constructed and arranged to secure said connector to an impact baton; said second attachment structure including threads; and (c) a quantity of dense, flowable, particulate material within said cavity; said quantity only occupying a partial amount of said first volume of said cavity.

2. A tip according to claim 1, wherein:

(a) said quantity of particulate material is no more than two-thirds of said first volume.

3. A tip according to claim 1, wherein:

(a) said quantity of particulate material is within a range of about one-half to about two-thirds of said first volume.

4. A tip according to claim 13, wherein:

(a) said particulate material comprises free-flow lead having an average diameter in a range of about 0.0116–0.0232 inch.

5. An impact baton for use in law enforcement to induce a fluid shock wave, the baton comprising:

(a) a handle adapted to allow for gripping by a user;

(b) a striking member in extension from said handle; and (c) a tip removably mounted to said striking member; said tip including:

(i) a housing having a wall and first and second opposite ends defining a cavity; said first end being closed, and said second end being selectively openable and closable; said cavity having a first volume;

(ii) a connector including a housing-engaging end and an opposite, baton-engaging end; said connector including:

(A) a first threaded attachment at said housing-engaging end constructed and arranged to secure said connector to said housing at said second end of said housing and close said second end; and (B) a second threaded attachment at said baton-engaging end constructed and arranged to secure said connector to said striking member; and (iii) a quantity of dense, flowable, particulate material within said cavity; said quantity only occupying a partial amount of said first volume of said cavity.

6. An impact baton according to claim 5, wherein:

(a) said quantity of particulate material is within a range of one-half and three-fourths of said first volume.

7. An impact baton according to claim 5, wherein:

(a) said quantity of particulate material is within a range of about one-half to about two-thirds of said first volume.

8. An impact baton according to claim 5, wherein:

(a) said particulate material comprises free-flow lead having an average diameter in a range of about 0.0116–0.0232 inch.

9. An impact baton according to claim 5, wherein:

(a) said handle is positioned substantially orthogonal to said striking member.

10. An impact baton according to claim 5, wherein:

(a) said handle is axially aligned with said striking member.

11. An impact baton according to claim 5, wherein:

(a) said striking member is telescoping, constructed and arranged to be movable between a closed position and an extended position.

12. A tip arrangement for use with an impact baton, the tip arrangement comprising:

(a) a housing having a wall, a closed first end, and an opposite selectively openable and closable second end; said housing defining a cavity having a first volume;

(b) a connector including first and second portions; said connector including:

(i) first threaded attachment structure at said first portion constructed and arranged to secure said connector to said housing at said second end of said housing to close said second end; and (ii) second threaded attachment structure at said second portion constructed and arranged to secure said connector to an impact baton; and (c) a quantity of dense, flowable, particulate material within said cavity; said quantity only occupying a partial amount of said first volume of said cavity.

13. A tip arrangement according to claim 12, wherein:

(a) said quantity of particulate material is within a range of one-half and three-fourths of said first volume.

14. A tip arrangement according to claim 12, wherein:

(a) said quantity of particulate material is within a range of about one-half to about two-thirds of said first volume.

15. A tip arrangement according to claim 14, wherein:

(a) said particulate material comprises free-flow lead having an average diameter in a range of about 0.0116–0.0232 inch.

* * * * *